US005402656A

United States Patent [19]

Jaster et al.

[11] Patent Number: 5,402,656

[45] Date of Patent: Apr. 4, 1995

[54] SPREAD SERPENTINE REFRIGERATOR EVAPORATOR

[75] Inventors: Heinz Jaster, Schenectady; Russell S. Miller, Ballston Spa, both of N.Y.

[73] Assignee: General Electric Company, Schenectady, N.Y.

[21] Appl. No.: 293,403

[22] Filed: Aug. 22, 1994

Related U.S. Application Data

[63] Continuation of Ser. No. 100,407, Aug. 2, 1993, abandoned.

[51] Int. Cl.[6] ..... F25B 39/02

[52] U.S. Cl. ..... 62/515; 165/122; 165/172

[58] Field of Search ..... 165/172, 121, 122; 62/515

[56] References Cited

U.S. PATENT DOCUMENTS

| | | | |
|---|---|---|---|
| 2,200,502 | 5/1940 | Johnson | 62/515 X |
| 4,269,035 | 5/1981 | Gelbard | 62/515 X |
| 5,067,322 | 11/1991 | Beers | 62/515 |
| 5,193,359 | 3/1993 | Martin et al. | 62/515 |
| 5,205,138 | 4/1993 | Besore et al. | 62/515 |
| 5,214,938 | 6/1993 | Kennedy et al. | 62/515 |

FOREIGN PATENT DOCUMENTS

| | | | |
|---|---|---|---|
| 2241219 | 3/1975 | France | 62/515 |
| 4620638 | 3/1968 | Japan | 62/515 |
| 0004244 | 1/1978 | Japan | 62/515 |

*Primary Examiner*—John C. Fox

*Attorney, Agent, or Firm*—Patrick R. Scanlon; Paul R. Webb, II

[57] ABSTRACT

A refrigerator evaporator is formed in a spread serpentine configuration having a plurality of straight tube segments and a plurality of bent tube segments where each one of the straight tube segments is joined at an acute angle to at least one other straight tube segment. The straight tube segments are arranged in a number of planar rows which are adjacent and parallel to one another. Approximately 25-50 percent of the cross-sectional area of the evaporator is not occupied by tubing or any attached fins. A cross flow blower disposed at one end of the evaporator draws air longitudinally over the evaporator.

5 Claims, 5 Drawing Sheets

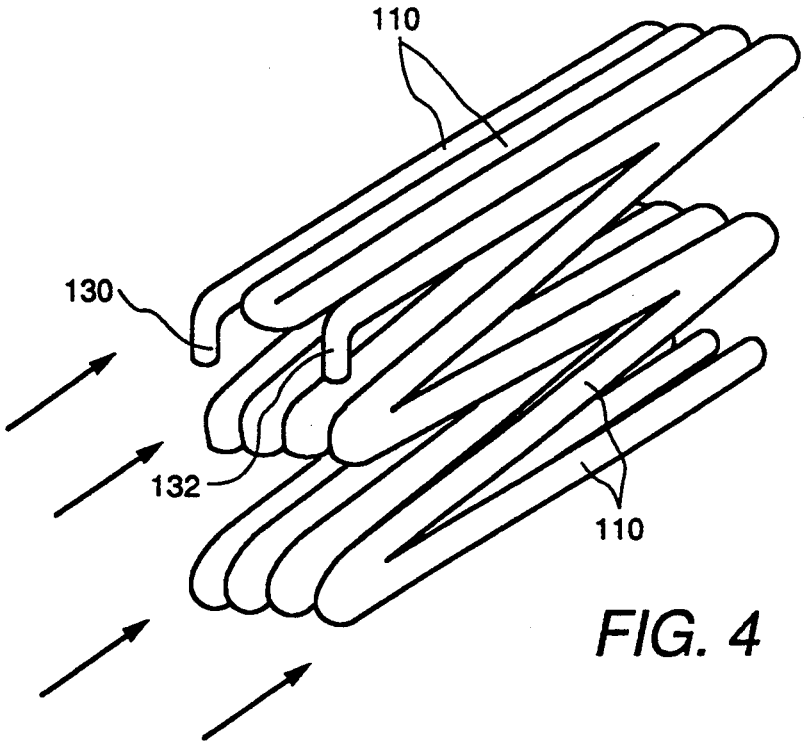
FIG. 4
FIG. 5
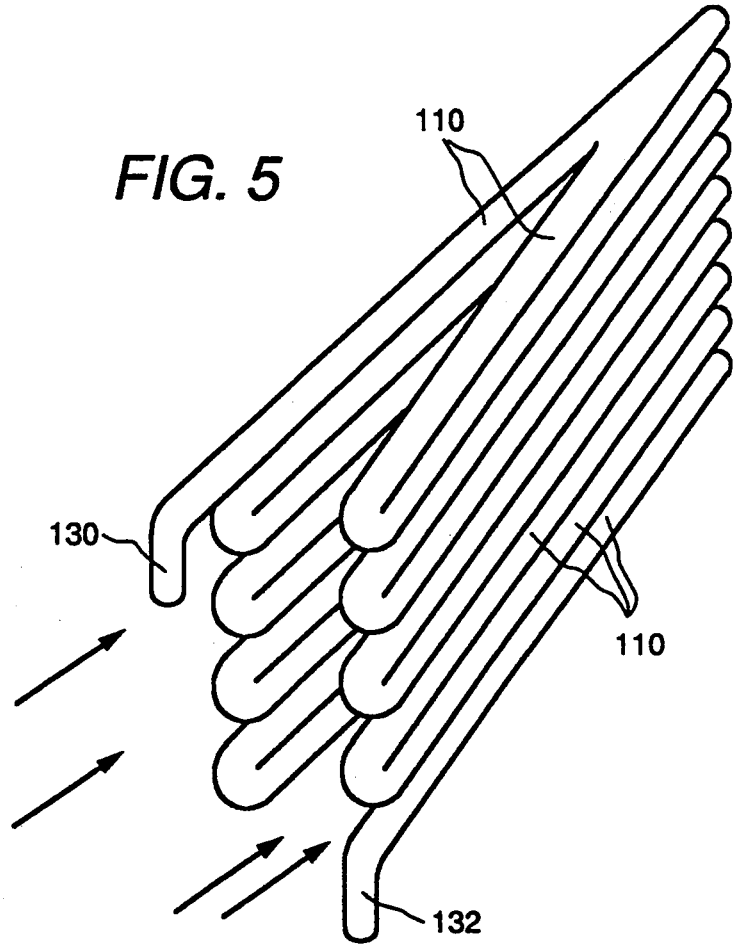

SPREAD SERPENTINE REFRIGERATOR EVAPORATOR

This application is a continuation of application Ser. No. 08/100,407, filed Aug. 2, 1993, now abandoned.

BACKGROUND OF THE INVENTION

This invention relates to heat exchangers in general and more particularly concerns refrigerator evaporators having a spread or flared serpentine configuration wherein adjacent straight runs of the tubing are not parallel.

Household refrigerators typically operate on the simple vapor compression cycle. Such a cycle includes a compressor, a condenser, an expansion device, and an evaporator connected in series and charged with a refrigerant. The evaporator is a specific type of heat exchanger which transfers heat from air passing over the evaporator to refrigerant flowing through the evaporator, thereby causing the refrigerant to vaporize. The cooled air is used to refrigerate one or more refrigerator compartments. A refrigerator evaporator for vapor compression cycles must satisfy several functional requirements. The most important of these are discussed below.

First, an evaporator must be thermally effective; that is, refrigerant flowing within the evaporator should exist at a saturation temperature which is not much lower than the temperature of the air flowing over the evaporator. This is because the higher the saturation temperature of the refrigerant is, the greater the efficiency of the refrigeration cycle will be. Consequently, the evaporator exit saturation temperature is indicative of the thermal effectiveness of the system.

Next, the evaporator must be effective in dehumidifying the air being refrigerated. If the air is not sufficiently dehumidified, then water droplets will form on various surfaces in the fresh food compartment and ice will form on various surfaces in the freezer compartment. An evaporator dehumidifies air by condensing air moisture as the air passes over the evaporator. Thus, air bypass of the evaporator must be minimized for effective dehumidification.

Because condensed moisture forms as frost or ice on the leading side of the evaporator surfaces, an effective evaporator must also be able to accumulate large amounts of ice without producing substantial air blockage. Ice accumulation on evaporator surfaces will eventually cause substantial cycle efficiency degradation. Most refrigerators are thus provided with a resistance heater which is periodically activated to defrost the evaporator. Defrosting energy use is parasitical. Frequent defrosting results in greater system energy use because much of the defrost heat is unavoidably diverted to un-iced surfaces rather than just melting ice. A desirable evaporator is therefore one which can accumulate substantial amounts of ice before defrosting is required.

Lastly, the evaporator must be compact because it occupies refrigerated space. The larger the evaporator and its associated components (i.e., fan, defrost heater, ducting, etc.) are, the less food storage space is available for the same cabinet size and energy use.

FIGS. 1A and 1B show a conventional top mount refrigerator 10 including an outer cabinet 11 containing a freezer compartment 12 and a fresh food compartment 14 with the freezer compartment 12 being disposed above the fresh food compartment 14. The freezer compartment 12 is maintained at below freezing temperatures and the fresh food compartment 14 is maintained at food preserving temperatures (i.e., temperatures which are typically above freezing but low enough to preserve food) by circulating air over a conventional evaporator 15. The evaporator 15 is a length of tubing having a plurality of elongated straight tube segments 22 and a plurality of return bent tube segments 24 formed in a serpentine coil arrangement. The straight tube segments 22 are connected in series for refrigerant flow therethrough, with the outlet of each straight tube segment 22 connected to the inlet of the next straight tube segment 22 by a bent tube segment 24. The straight tube segments 22 are generally closely spaced and parallel to one another. Some of the bent tube segments are bent in a different plane to define additional rows of the straight tube segments (such as the three rows shown in FIG. 1A). The evaporator tubing is typically provided with fins to improve the heat exchange per unit length of the tube.

The evaporator 15 is disposed within an evaporator chamber 16 located in the freezer compartment 12; the evaporator 15 extending lengthwise across the freezer compartment 12. The evaporator chamber 16 is formed by a vertically extending front panel 17 separating the evaporator chamber 16 from the rest of freezer compartment 12, substantially parallel side walls 18, and an inner rear liner 19 of the refrigerator 10. Thus, the evaporator chamber 16 fills an entire top-to-bottom portion in the rear of the freezer compartment 12. The evaporator 15 is supported within the evaporator chamber 16 by each of the bent tube segments 24 being retained within a corresponding opening in one of a pair of substantially parallel end channels attached to respective ones of the side walls 18. Each of the end channels may be formed by galvanized steel or aluminum. The end channels may have mounting holes therein for mounting to the freezer liner of the refrigerator 10. The liner may have special receptacles or supports to allow for attachment.

A motor driven axial fan 20 is positioned in the upper portion of the evaporator chamber 16 so that the rotational axis of the fan is perpendicular to the front panel 17. The fan 20 causes cooled air to be discharged through openings 21 in the front panel 17 of the evaporator chamber 16 into the freezer compartment 12. Some of the air flows through a passage (not shown) into the fresh food compartment 14 in a manner well known in the art. This division of the cooling air is such that the freezer compartment 12 is maintained at below freezing temperatures and the fresh food compartment 14 is maintained at food preserving temperatures. The fan 20 also draws air from the freezer compartment 12 and the fresh food compartment 14 into the lower portion of the evaporator chamber 16. Thus, the return air flows vertically over of the evaporator 15 in a transverse manner. This transverse air flow is substantially perpendicular to the elongated straight tube segments 22 of the evaporator 15. After flowing over the evaporator 15, the direction of air flow is first bent 90° to the left by the fan 20 and is then bent 180° to the right to flow through the openings 21. Thus, the air flow must be bent through a total angle of 270° in passing over the evaporator 15 and through the openings 21.

This arrangement requires substantial space for inlet and exit plenums and incurs inlet and exhaust pressure drop which provides no heat transfer benefit. As seen in FIG. 1A, the plenum and fan space uses almost as much of the evaporator chamber volume as the evaporator 15. Furthermore, frost tends to build up only on the lowermost portion of the evaporator 15. This is because as the moist return air initially contacts the bottom of the evaporator 15, most or all of the moisture is immediately removed from the air and deposited as frost on the lowest portion of the evaporator 15. As the air continues to pass over the evaporator 15, there is little or no moisture remaining in the air so that the upper portion of the evaporator 15 receives little or no frost. This uneven frost distribution means that frost tends to build up quickly and frequent defrosting is required.

Accordingly, there is a need for an energy efficient, compact refrigerator evaporator which can accumulate large amounts of frost.

SUMMARY OF THE INVENTION

The above-mentioned need is met by the present invention which provides an evaporator comprising an elongated tube having a plurality of straight tube segments and a plurality of bent tube segments formed in a serpentine arrangement. Each one of the straight tube segments is joined by one of the bent tube segments to at least one other straight tube segment in a non-parallel relationship. Each one of the bent tube segments joining two straight tube segments in a non-parallel relationship defines an acute angle. The straight tube segments are arranged in at least one planar row and preferably a plurality, such as three, of adjacent and parallel planar rows. Approximately 25–50 percent of the cross-sectional area of the evaporator is not occupied by tubing including any fins which may be attached thereto. The evaporator is disposed in an evaporator chamber located in the freezer compartment of the refrigerator. A cross flow blower is disposed in the evaporator chamber at one end of the evaporator to cause air to flow longitudinally over the evaporator.

Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

FIG. 4 is a perspective view of a second embodiment of the evaporator of the present invention;

FIG. 5 is a perspective view of a third embodiment of the evaporator of the present invention.

DETAILED DESCRIPTION OF THE INVENTION

Figure 2C:
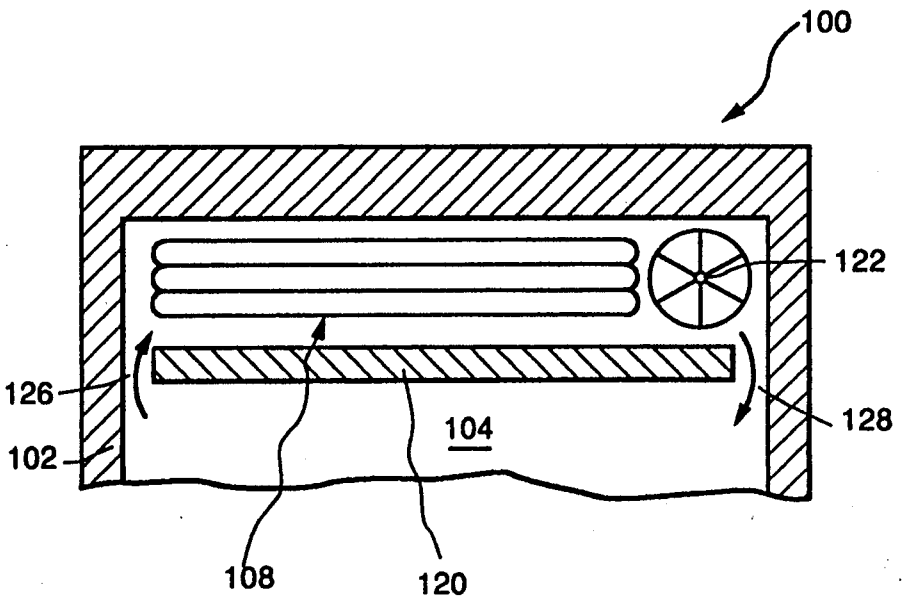
FIG. 2C is a partial cross-sectional top view of a refrigerator having the evaporator system of the present invention.
Figure 2A:
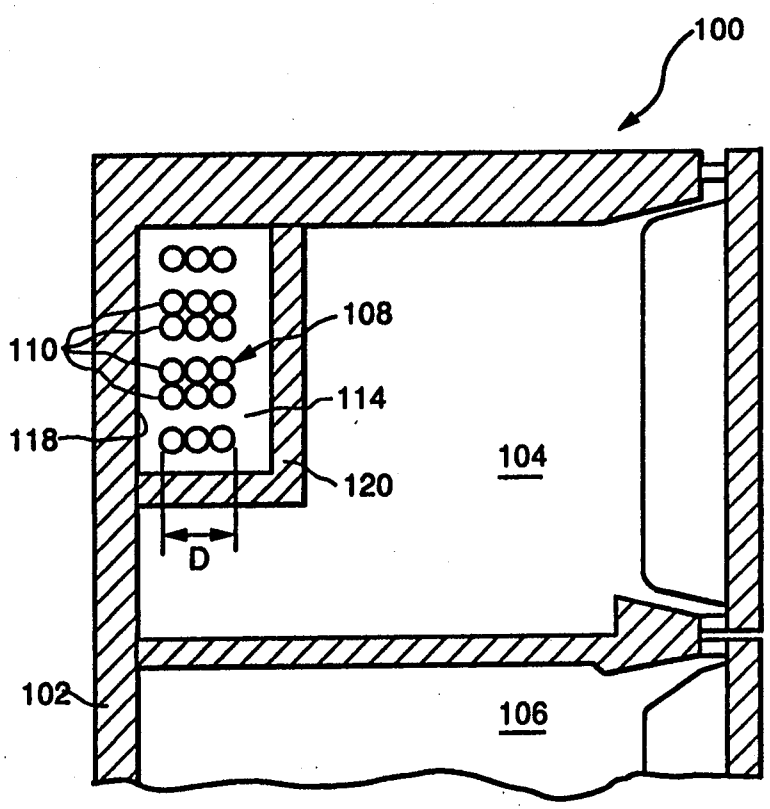
FIG. 2A is a partial cross-sectional side view of a refrigerator having the evaporator system of the present invention.
Figure 2B:
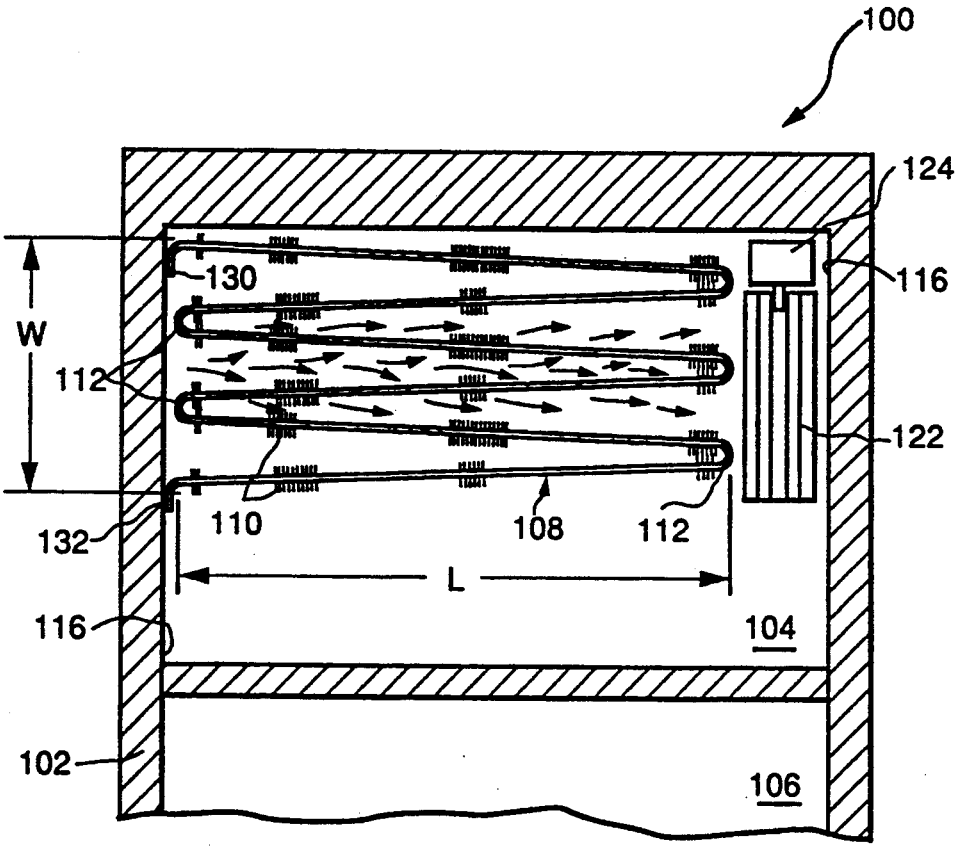
FIG. 2B is a partial cross-sectional front view of a refrigerator having the evaporator system of the present invention.

Referring to the drawings wherein identical reference numerals denote the same elements throughout the various views, FIGS. 2A–2C show a refrigerator 100 including an outer cabinet 102 containing a freezer compartment 104 and a fresh food compartment 106. The freezer compartment 104 is shown as being disposed above the fresh food compartment 106, but the present invention is not limited to this construction. The present invention is applicable to many other types of refrigerators, including the well known side-by-side design. Furthermore, although the present invention is particularly applicable to household refrigerators, it is not so limited and can be used for other heat exchange applications such as in an air conditioner.

The freezer compartment 104 is maintained at below freezing temperatures and the fresh food compartment 106 is maintained at food preserving temperatures by circulating air over an evaporator 108 which is the subject the present invention. The evaporator 108 is a heat exchanger comprising an elongated tube which is bent into a serpentine coil so as to have a plurality of elongated straight tube segments 110 and a plurality of return bent tube segments 112 connected in series. The evaporator tubing is bent back upon itself so as to define at least one planar, vertically extending row of the straight tube segments 110. Some of the bent tube segments 112 can be bent in a different plane so as to define additional planar rows of the straight tube segments 110 (three such rows are shown in FIGS. 2A and 2C). The vertical rows of straight tube segments are positioned in parallel, side-by-side relation so as to be stacked horizontally. The outlet of each straight tube segment 110 is connected to the inlet of the next straight tube segment 110 by one of the return bent tube segments 112. The evaporator 108 differs from prior art evaporators in that it has a flared or spread serpentine configuration. That is, the serpentines are flared or spread apart so that the return bends are not a full 180 degrees. As a result, adjacent straight tube segments in each row are joined at an acute angle so as to define a non-parallel relationship.

The evaporator 108 is disposed within an evaporator chamber 114 which is preferably, but not necessarily, located in the upper rear of the freezer compartment 104. The evaporator chamber 114 is defined by the two substantially parallel side walls 116 of the freezer compartment 104, the rear wall 118 of the freezer compartment 104, and an L-shaped front panel member 120 which separates the evaporator chamber 114 from the rest of the freezer compartment 104. The front panel member 120, which is omitted from FIG. 2B to better show the evaporator 108, has a horizontally extending portion which extends outwardly from approximately the middle of the rear wall 118 of the freezer compartment 104 and a vertically extending portion which extends from the distal end of the horizontally extending portion to the top of the freezer compartment 104 in a plane near the rear wall 118. Thus, the evaporator chamber 114 extends across the full width of the freezer compartment 104, but covers only about half the height and a fraction of the depth of the freezer compartment 104.

The evaporator 108 has a width, W, and a depth, D, which are substantially equal to the corresponding dimensions the evaporator chamber 114, but the length, L, of the evaporator 108 is slightly less than the width of the evaporator chamber 114. A cross flow blower 122 and a motor 124 for driving the blower 122 are located in the resulting space between the side wall 116 of the freezer compartment 104 and one end of the evaporator 108. Cross flow blowers (also known as transverse flow blowers) differ from axial fans in that air is blown in a direction perpendicular to, rather than parallel to, the rotational axis of the device. Thus, the rotational axes of the cross flow blower 122 and the motor 124 can be disposed vertically in the evaporator chamber 114, thereby using less space. The cross flow blower also gives a more uniform velocity distribution than an axial fan because it spans almost the entire width of the evaporator 108.

The blower 122 causes air to be circulated over the evaporator 108 and throughout the freezer compartment 104. Specifically, the blower 122 draws air from the freezer compartment 104 through inlet openings 126 in the left side (as shown in FIG. 2C) of the front panel member 120 and discharges air through outlet openings 128 in the right side of the front panel member 120 into the freezer compartment 104. Thus, the return air flows horizontally over the evaporator 108 in a left-to-right manner as shown in FIG. 2C. As such, the blower 122 creates a longitudinal air flow; that is, the air flows substantially along the length of the evaporator 108 instead of transverse to the length. As shown in FIG. 2B, air flowing over the evaporator 108 enters one of the "wedges" formed by adjacent straight tube segments 110 in each row. At some point along the length of the evaporator, air is forced to cross one of the straight tube segments 110 into another "wedge" formed by adjacent straight tube segments and then exits the evaporator space. Thus, it can be seen that each pocket of air passes over only one of the tube segments.

After passing over the evaporator 108, the air only need be bent 90° in order to be blown into the freezer compartment 104. Some of the cooling air flows from the freezer compartment 104 through a passage (not shown) into the fresh food compartment 106 in a manner well known in the art. (Likewise some of the return air is drawn from the fresh food compartment 106. ) This division of the cooling air is such that the freezer compartment 104 is maintained at below freezing temperatures and the fresh food compartment 106 is maintained at food preserving temperatures.

Figure 1B:
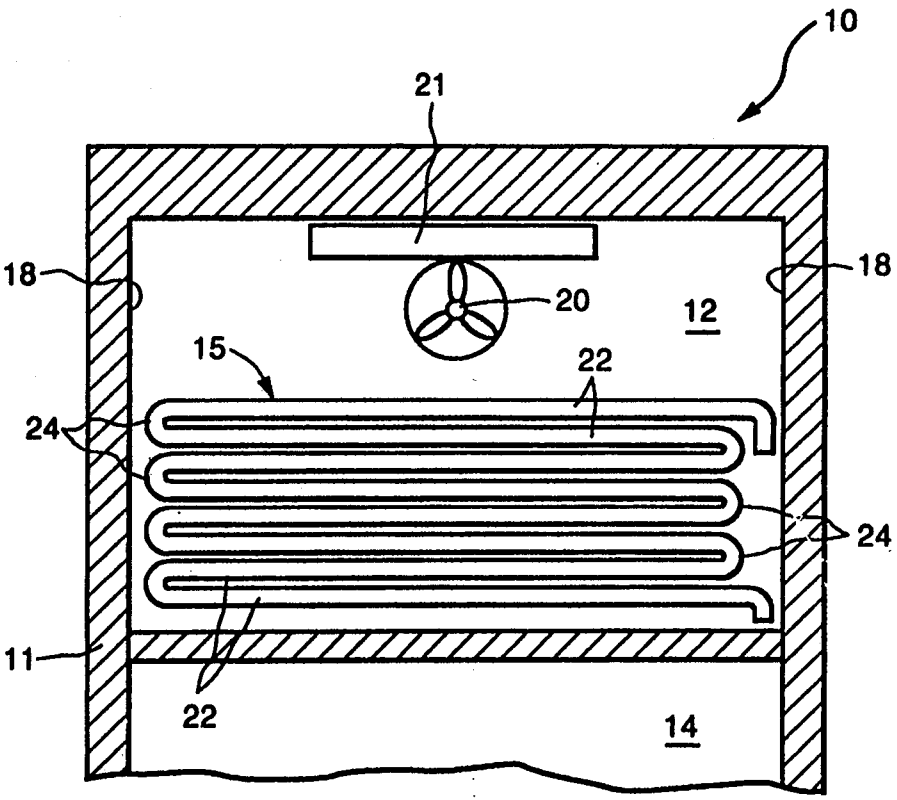
FIG. 1B (PRIOR ART)
FIG. 1B is a partial cross-sectional front view of a refrigerator having a conventional evaporator system.
Figure 1A:
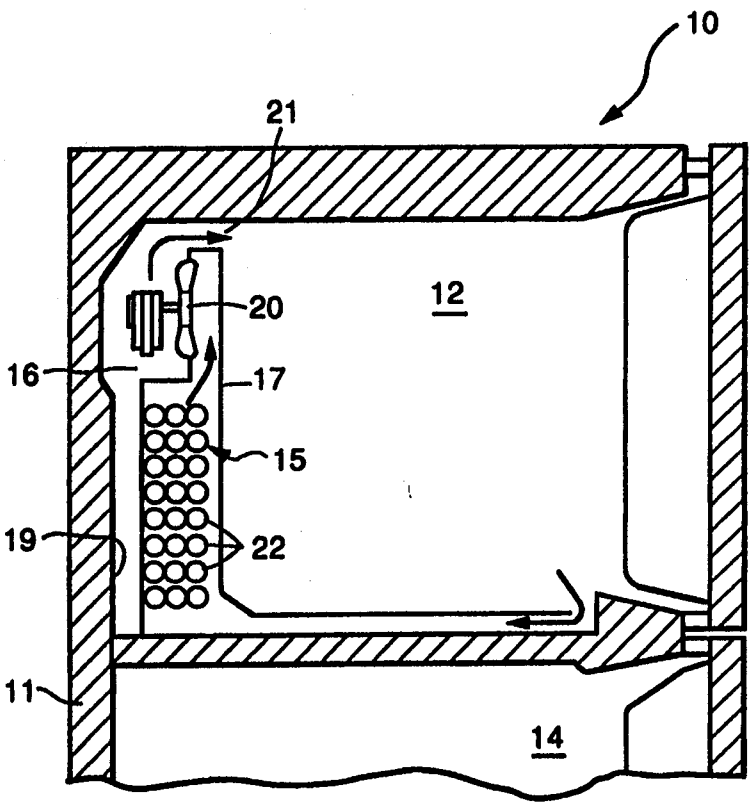
FIG. 1A (PRIOR ART)
FIG. 1A is a partial cross-sectional side view of a refrigerator having a conventional evaporator system.

As shown in FIGS. 2A–2C, the evaporator 108 comprises six straight tube segments 110 in each one of the three rows for a total of 18 straight tube segments 110. The present invention is not necessarily limited to six straight tube segments, but does generally have fewer straight tube segments than conventional evaporator coils of similar overall size. To this point, the prior art evaporator 15 of FIGS. 1A and 1B has eight parallel straight tube segments 22 in each of three rows for a total of 24 straight tube segments 22. Fewer straight tube segments allows for the evaporator 108 to be spread apart without requiring a greater total width but also means that there is less total tubing length. However, as will be described in more detail below, the performance of the present invention is not compromised because of an increased heat-transfer coefficient of the new configuration.

In addition to width constraints, the degree to which the straight tube segments 110 can be spread apart is controlled by the amount of resulting open area, i.e., the percentage of the total evaporator cross-sectional area which is not occupied by the "tube volume" of the tubing. As used herein, the term "tube volume" simply refers to the space defined by the actual tubing when external fins are not present. Or in the case of externally finned tubing, the term "tube volume" refers to the space inside the boundary defined by the outer tips of the fins. The open area will be essentially the same at any point along the length of the evaporator. For acceptable performance, the open area produced by the spread configuration should fall within an range of approximately 25–50%. If the open area is below about 25% then the air-side pressure drop becomes too great, and if the open area is greater than about 50%, then evaporator performance suffers due to either insufficient heat transfer volume or air velocity being too small. In order to provide the desired degree of open area, the acute angle formed between each pair of adjacent straight tube segments should approximately range between about 3–25 degrees, preferably between about 4–9 degrees for evaporators of typical dimensions. The typical dimensions mentioned above refer to lengths of about 20–24 inches and widths (based on six straight tube segments per row) of 7.5–12 inches.

The serpentine evaporator 108 has refrigerant supplied from a condenser (not shown) via an expansion device (not shown) as is well known in the art through an inlet tube 130 connected to one end of a first one of the elongated straight tube segments 110. From this first one of the straight tube segments 110, the refrigerant flows serially through the remaining straight tube segments 110 and the return bent tube segments 112 to a final one of the straight tube segments 110 which is connected to an outlet tube 132. Refrigerant flows out of the evaporator 108 through the outlet tube 132 to a compressor (not shown) as is well known in the art.

Figure 3:
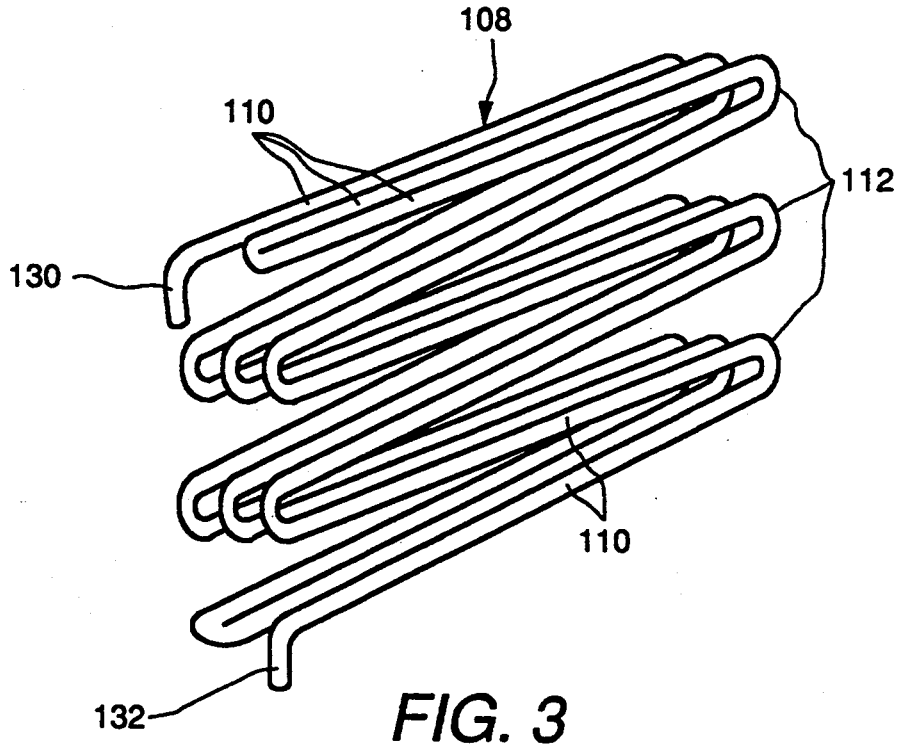
FIG. 3 is a perspective view of the evaporator of the present invention.

The flow of refrigerant through the evaporator 108 is best shown with reference to FIG. 3. The refrigerant flows from the inlet tube 130 into the uppermost of the straight tube segments 110 of the rear row. The refrigerant then flows downward through the straight tube segments 110 and the return bent tube segments 112 of the rear row until it reaches the lowermost straight tube segment in the rear row. From there, the refrigerant flows through a horizontally-oriented bent tube segment 112 to the lowermost of the straight tube segments 110 in the middle row and then flows upwardly through the middle row tube segments. The refrigerant flows from the uppermost of the straight tube segments 110 of the middle row through another horizontally-oriented bent tube segment 112 to the uppermost of the straight tube segments 110 in the front row. The refrigerant then flows downward through the tube segments of the front row. The lowermost of the straight tube segments 110 in the front row is connected to the outlet tube 132 to enable the refrigerant to be removed from the evaporator 108.

This refrigerant flow scheme is presently preferred and should provide optimal performance, due to the pressure drop through the evaporator 108. Furthermore, this flow scheme provides for a "downflow" of refrigerant in the last row of tube segments. The downflow arrangement allows gravity to drain any excess refrigerant out of the evaporator 108. However, other refrigerant flow schemes may be incorporated. For example, the refrigerant flow path could be the reverse of that described, that is with the refrigerant entering through the tube 132 and exiting through the tube 130. In this case, the evaporator 108 provides for an "upflow" of refrigerant through the final row of tube segments. This upflow of the refrigerant tends to minimize slugging of liquid refrigerant at the inlet of the compressor.

The evaporator tubing is made of a material, such as aluminum or the like, which has an excellent thermal conductivity. As is known in the art, the evaporator tubing is preferably provided with fins to increase the air-side heat transfer per unit length of tubing, thereby decreasing the amount of tubing required. One preferred type of fin is the so-called spine fin. Spine fin tubing is typically fabricated by providing a continuous strip of aluminum or other such material which is folded and sheared to produce many thin, narrow fins attached to an unsheared shoulder. This shoulder is helically wound around the tubing in a good heat transfer relationship. In the process, the fins are separated to protrude radially away from the tube. Spine fin tubing provides an exceptionally good air side heat transfer surface because the air side surfaces are too small to develop thick boundary layers (thus, the heat transfer coefficient is always high), and because air flow is highly turbulent, leading to exceptional air mixing.

Internally-finned tubing (not shown) can be used to increase refrigerant-side heat transfer. The flow of refrigerant through evaporator tubing is typically stratified; i.e., liquid refrigerant flowing along the bottom of the tubing and gaseous refrigerant flowing along the top of the tubing. Phase change is via film vaporization from the liquid surface. The low conductivity of refrigerants combined with the thick film and small surface area of stratified flow produces a relatively poor refrigerant-side heat transfer. Helically formed internal fins will break up the stratified flow and tend to produce an annular film of liquid refrigerant along the inner surface of the tubing. The annular film is thinner and provides a higher surface area than occurs with stratified flow, thereby increasing the refrigerant-side heat transfer. The use of internal fins is particularly beneficial in the present invention For ease of illustration, the spine fin tubing is merely shown as cylindrical tubing in most views of the drawings. In the front views of FIGS. 2B and 6, the spine fin material is schematically shown extending along only small portions of the elongated straight tube segments 110, with no spine fin material shown on the return bent tube segments 112. However, spine fin material is preferably provided along the entire length of the evaporator tubing, the bent tube segments 112 as well as the straight tube segments 110. It should be understood that many of the spine fins on the bent tube segments 112 may become bent or compressed during formation of the evaporator 108. This does not materially affect evaporator operation.

As mentioned above, the evaporator of the present invention can comprise a different number of straight tube segments than is shown in FIGS. 2A–2C. Different spread serpentine configurations of the straight tube segments are also possible. For instance, FIG. 4 shows an embodiment having four rows of five straight tube segments 110 each for a total of 20 straight tube segments 110. The inlet tube 130 and the outlet tube 132 are connected to the uppermost straight tube segment of the rear and front rows, respectively. FIG. 5 shows an embodiment having nine horizontally-extending rows of two straight tube segments 110 each for a total of 18 straight tube segments 110. Adjacent rows are stacked vertically instead of horizontally. The inlet tube 130 is connected to the left straight tube segment of the upper row, and the outlet tube 132 is connected to the right straight tube segment of the bottom row. The longitudinal air flow direction is indicated by arrows in FIGS. 4 and 5. Each of the alternate embodiments can be configured to have similar length, width and depth dimensions as shown and thereby occupy approximately the same of amount refrigerated space.

Figure 6:
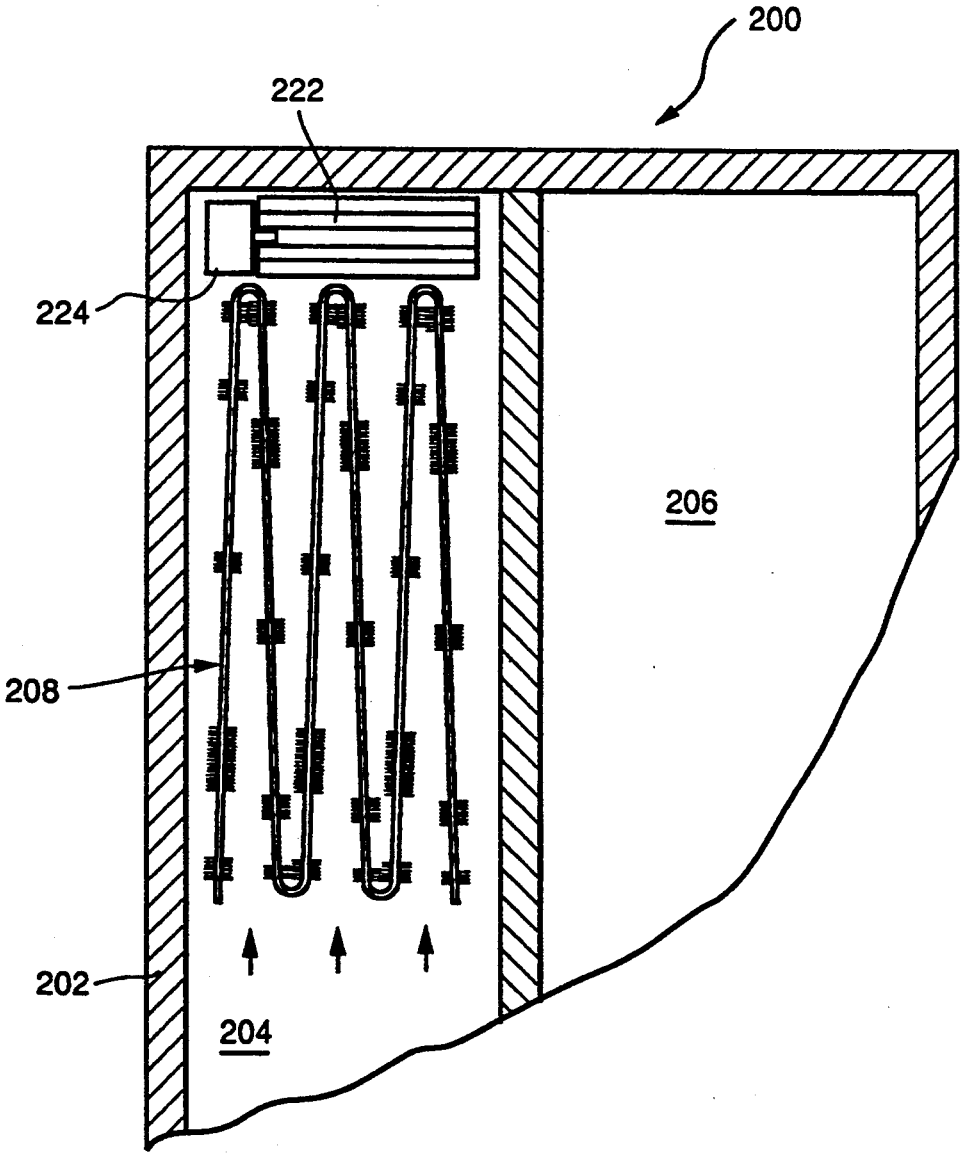
FIG. 6 is a partial cross-sectional front view of a side-by-side refrigerator having the evaporator system of the present invention.

In addition, the evaporator of the present invention is not limited to top mount refrigerators and is applicable to other types such as side-by-side refrigerators, i.e., refrigerators in which the fresh food and freezer compartments are positioned side-by-side. In this case, the freezer compartment has a more elongated shape than a top mount freezer and is oriented to extend vertically. FIG. 6 shows a side-by-side refrigerator 200 having an outer cabinet 202 containing a freezer compartment 204 and a fresh food compartment 206 adjacent to the freezer compartment 204. A spread serpentine evaporator 208 is preferably positioned in the upper rear portion of the freezer compartment 206 so that its length extends vertically as shown in FIG. 6. The evaporator 208 is essentially the same as the evaporator 108 of the top mount embodiment except for the vertical orientation. A cross flow blower 222 and an associated motor 224 are disposed above the evaporator 208. The blower 222 creates an upward, longitudinal flow of air over the evaporator 208.

Many advantages are realized by using the spread serpentine evaporator 108 with longitudinal air flow. First, this arrangement provides for excellent dehumidification of air because very little or no air is able to bypass cold evaporator surfaces. The present invention also provides a significant advantage in accumulating frost. Unlike conventional evaporators where frost builds up rapidly on only a small portion of the evaporator surfaces, the present invention exposes a much larger percentage of the evaporator tubing to the moist return air because each pocket of air passes over one and only one of the tube segments. Thus, frost evenly accumulates on the leading side of nearly all of the evaporator surfaces. This uniform distribution of frost means that defrosting is needed less frequently.

Despite its spread configuration, the evaporator system of the present invention actually uses less space than many conventional systems while providing at least equal performance. The present invention is more compact for two primary reasons. First, due to the use of the cross flow blower 122 and the longitudinal air flow scheme, less space is required for the blower, ducting and air plenums. The cross flow blower 122 performs just one 90° bend of the air in blowing it into the freezer compartment 104 instead of the 270° bend produced by conventional systems. Thus, much less duct space is required.

Second, the evaporator 108 requires less total tubing length than conventional evaporators to produce the same cooling capacity because of a more efficient heat transfer. (Using less tubing provides the ancillary benefit of lowering the cost of the evaporator.) For the same flow rate of air, the velocity of air passing over the evaporator 108 is greater than in a conventional system because the cross-sectional area the air passes through is considerably smaller for longitudinal air flow as opposed to transverse flow. And since the convection heat-transfer coefficient is directly proportional to the air velocity, a higher velocity creates a greater heat transfer rate.

This is shown mathematically by the well known heat transfer relation:

$$Q=UA\Delta T \quad (1)$$

where Q is the total rate of heat transfer from the air to the refrigerant in the tubing, A is the heat exchange area, i.e., the area of tubing exposed to the air, U is the overall heat-transfer coefficient, and $\Delta T$ is the difference in temperature between the air and the refrigerant. The overall heat-transfer coefficient is defined as:

$$U = \frac{1}{1/h_{ext} + \Delta x/k + 1/h_{int}} \quad (2)$$

where $h_{ext}$ is the convection heat-transfer coefficient for the exterior of the tubing, $\Delta x$ is the thickness of the tubing, k is the thermal conductivity of the tubing, and $h_{int}$ is the convection heat-transfer coefficient for the interior of the tubing.

From Equation (2), it can be seen that an increase in the exterior convection heat-transfer coefficient, $h_{ext}$, (due to increased air velocity) will cause the overall heat-transfer coefficient, U, to increase. An increase in the overall heat-transfer coefficient, U, will permit a commensurate decrease in the heat transfer area, A, without reducing the heat transfer, Q. For this reason, the evaporator of the present invention can achieve comparable performance using less tubing. Equation (2) also demonstrates why internal fins are particularly useful in the present invention. As the exterior convection heat-transfer coefficient, $h_{ext}$, becomes quite large due to the increased air velocity, the term $1/h_{ext}$ in the denominator of Equation (2) approaches zero. In this case, an increase in the interior convection heat-transfer coefficient, $h_{int}$, creates a greater increase in the overall heat-transfer coefficient, U, than it would if the $1/h_{ext}$ term was not so small.

The above-described benefits of the present invention are exemplified with reference to Table 1 which provides comparison data for two conventional evaporators and three evaporators implementing the spread serpentine configuration of the present invention. Evaporator 1 is a conventional closed serpentine evaporator of the type described in connection to FIGS. 1A and 1B and primarily used in top mount refrigerators. This evaporator comprises 48 feet of tubing formed into three rows of eight straight tube segments for a total of 24 straight tube segments. Each straight tube segment is 24 inches long. Refrigerant enters at the top of the front row and initially flows down. Refrigerant flow is up in the middle row and down in the rear row to exit at the bottom. Air flow is upward normal to the straight tube segments and is permitted to enter the tube bend space at the bottom of the evaporator, but is forced into only the straight tube segment region at the top.

Evaporators 2A and 2B are both conventional racetrack evaporators. Racetrack evaporators comprise spine fin tubing helically wound in an oval coil arranged vertically for use in side-by-side refrigerators. Evaporators 2A and 2B have the same physical construction, the only difference being that evaporator 2A has an upflow of refrigerant and evaporator 2B has a downflow of refrigerant. In both cases, air flow is upward. The tested evaporator has 42 180° bends so that the length between bends is 9.8 inches and the width of the evaporator is 3.1 inches. To reduce air bypass, one tube from approximately every second row has been pushed or "dunked" toward the open center of the oval configuration.

Evaporator 3 is the spread serpentine evaporator shown in FIGS. 2A–2C and arranged horizontally for use in a top mount refrigerator. This evaporator comprises 31.5 feet of tubing formed into three rows of six straight tube segments for a total of 18 straight tube segments. Each straight tube segment is 21.5 inches long. Air flow is longitudinal with respect to the evaporator. Refrigerant flow is as described above in connection with FIGS. 2A–2C.

Evaporator 4 has the same physical construction as evaporator 3 but is arranged vertically for use in a side-by-side refrigerator. Because of the vertical positioning of the evaporator, air flows upwardly to achieve the longitudinal air flow pattern, and refrigerant flow is alternatively with and against gravity.

Evaporator 5 is another spread serpentine evaporator arranged vertically for use in a side-by-side refrigerator. Evaporator 5 has different dimensions than evaporator 4 to more fully utilize the space typically available in a side-by-side refrigerator. Specifically evaporator 5 comprises 33 feet of tubing formed into three rows of seven straight tube segments for a total of 21 straight tube segments. Each straight tube segment is 19 inches long. Evaporator 5 is wider but not as long as evaporators 3 and 4. Air and refrigerant flows are the same as for evaporator.4.

Each of the tested evaporators comprises aluminum spine fin tubing having an outside diameter of 0.375 inches. The overall diameter including the spine fins is 1.08 inches. Each evaporator was operated at 17.5 lbm/hr refrigerant (R-12) flow and 55 ACFM air flow at an inlet air temperature of 8° F. and saturated vapor exit conditions.

TABLE 1

| Evap | Exit Sat. Temp. (°F.) | Refrig. Pressure Drop (PSI) | Air Side Pressure Drop (In $H_2O$) | Tubing Length (Ft) | Coil Volume ($Ft^3$) | Heat Transfer Volume ($Ft^3$) | System Volume ($Ft^3$) | Frost Area ($In^2$) | Air Bypass |
|---|---|---|---|---|---|---|---|---|---|
| 1 | −11.0 | 1.0 | 0.040 | 48 | 0.35 | 0.30 | 0.90 | 62 | small |
| 2A | −11.0 | 1.0 | 0.082 | 44 | 0.58 | 0.46 | 1.26 | >30 | high |
| 2B | −13.0 | 1.2 | 0.082 | 44 | 0.58 | 0.46 | 1.26 | >30 | high |
| 3 | −11.9 | 0.7 | 0.090 | 32 | 0.37 | 0.37 | 0.50 | 310 | small |
| 4 | −12.3 | 1.8 | 0.090 | 32 | 0.37 | 0.37 | 0.50 | 310 | small |
| 5 | −12.4 | 1.8 | 0.065 | 33 | 0.38 | 0.38 | 0.50 | 330 | small |

In Table 1, system volume refers to the volume required for the evaporator coil, the primary air ducting, and the air mover. It does not include volume for ducting to the fresh food compartment. The heat transfer volume is based on the portion of the evaporator coil volume exposed to significant air flow. The frosting area is the area of each evaporator that is presented to the flow of moist return air; this assumes that the leading sides of all effected tubes are actively frosting. The frosting area of evaporators 2A and 2B is ill-defined because of the large degree of air bypass up the center of the oval coil. It is known that the frosting area is greater than the frontal (i.e., normal to air flow) area of evaporators 2A and 2B which is about 30 $in^2$.

As can be seen from Table 1, the evaporators implementing the features of the present invention have performance which is comparable to the conventional evaporators while providing significantly more frosting area. (Although the frosting area of evaporators 2A and 2B is ill-defined, it will be considerably less than that of evaporators 3–5.) Evaporators 3–5 have considerably less tubing length and form a coil volume which is comparable to the coil volume of evaporator 1 and much smaller than that of evaporators 2A and 2B. Virtually 100 percent of the coil volume of evaporators 3–5 is actively involved in heat transfer, compared with less than 90 percent for each of the conventional evaporators. The overall system volume of the inventive evaporators is markedly less than that of the conventional evaporators. The air bypass of the spread serpentine evaporators is clearly better than that of evaporators 2A and 2B and at least as good as that of evaporator 1.

The foregoing has described a refrigerator evaporator which occupies less refrigerated space than conventional evaporators while providing at least comparable performance. This evaporator also excels in the functional requirements of dehumidifying air and accumulating frost.

While specific embodiments of the present invention have been described, it will be apparent to those skilled in the art that various modifications thereto can be made without departing from the spirit and scope of the invention as defined in the appended claims.

What is claimed is:

1. A refrigerator comprising:

a refrigerated compartment having an upper rear portion;

an evaporator chamber located entirely in said upper rear portion of said refrigerated compartment;

an evaporator disposed in said evaporator chamber, said evaporator including an elongated tube having a plurality of straight tube segments and a plurality of bent tube segments formed in a serpentine arrangement, wherein each one of said bent tube segments joins two of said straight tube segments and each one of said straight tube segments is joined by one of said bent tube segments to at least one other of said straight tube segments at an acute angle so as to define a non-parallel relationship; and a cross flow blower disposed in said evaporator chamber at one end of said evaporator so as to cause air to flow longitudinally over said evaporator, said cross flow blower having a rotational axis which is disposed vertically in said evaporator chamber.

2. The refrigerator of claim 1 wherein said straight tube segments are arranged in at least one planar row.

3. The refrigerator of claim 1 wherein said straight tube segments are arranged in a plurality of planar rows, said planar rows being arranged adjacent and parallel to one another.

4. The refrigerator of claim 3 wherein there are three of said planar rows.

5. The refrigerator of claim 1 wherein said elongated tube defines a tube volume and about 25–50 percent of the cross-sectional area of said evaporator is not occupied by said tube volume.

* * * * *